United States Patent [19]

Perry

[11] 4,127,382

[45] Nov. 28, 1978

[54] PROCESS FOR THE REDUCTION OF FREE FORMALDEHYDE ON TEXTILE FABRICS

[76] Inventor: Ronald S. Perry, 6 Connecticut Ave., Barrington, R.I. 02806

[21] Appl. No.: 789,362

[22] Filed: Apr. 21, 1977

[51] Int. Cl.[2] ..... D06M 13/34

[52] U.S. Cl. ..... 8/181; 8/182; 8/184; 8/185; 8/187; 8/189

[58] Field of Search ..... 8/187, 184, 189, 181, 8/116 V, 116 VM, 94.33, 182, 185

[56] References Cited

U.S. PATENT DOCUMENTS

| | | | |
|---|---|---|---|
| 2,183,754 | 12/1939 | Schlack | 8/57 |
| 2,246,070 | 6/1941 | Schlack | 8/113 |
| 3,723,377 | 3/1973 | Spangler | 260/29.4 R |
| 3,749,751 | 7/1973 | Pai | 8/187 |
| 3,957,431 | 5/1976 | Pai et al. | 8/182 |

FOREIGN PATENT DOCUMENTS 7,471,103 7/1974 Japan.

OTHER PUBLICATIONS

Bille, H. and Petersen, H., *Melliand Textilberichte,* 1976, 67, (No. 2), pp. 155–165.

Bergman, Chem. Abstracts, 1970, 73, 76978c.

Naniwa Plywood, Chem. Abstracts, 1975, 82, 45451g.

Alley, Chem. Abstracts, 1975, 83, 43239r.

*Primary Examiner*—A. Lionel Clingman

*Attorney, Agent, or Firm*—Richard P. Crowley

[57] ABSTRACT

A process for scavenging free formaldehyde from cellulosic-containing articles, such as textile materials, which process comprises contacting the cellulosic-containing textile material containing free formaldehyde with a formaldehyde scavenger which comprises a heterocyclic compound free of carbonyl groups, and containing an NH group, with the ring made up of nitrogen or carbon atoms, the ring being unsaturated or, when fused to a phenyl group, being unsaturated or saturated, and the NH group bonded to a carbon or nitrogen atom which is directly bonded by a double bond to a carbon or nitrogen atom.

27 Claims, No Drawings

PROCESS FOR THE REDUCTION OF FREE FORMALDEHYDE ON TEXTILE FABRICS

BACKGROUND OF THE INVENTION

Textile-treating resins, typically aminoplast-forming substances, such as N-methylol monomeric and polymeric compounds, such as urea-formaldehyde resins, have been widely employed in the treatment of textile fabrics, particularly rayon, cotton and blends therewith, with noncellulosic textiles, such as polyesters, to impart permanent-press, such as wrinkle-resistant, crease- and shape-retentive, properties and other desirable properties to the treated fabric. One process of treating the textile material comprises: impregnating the material with an aqueous solution of the aminoplast-forming substances, such as by immersion in a textile-treating bath; drying the treated material to a precured or sensitized state; and, thereafter, either before or after the fabrication of the treated fabric in its sensitized state into a finished garment, curing the aminoplast-forming substances on the treated material. Thus, in one process known as the precure process, the textile fabric is treated, resinated and cured, and the garment then is fabricated, while in the post-cure process, the textile fabric is treated, dried, fabricated into a garment and then cured. Optionally, the treated material, either after the precuring or sensitizing and drying steps or after the curing step, may be treated further to impart other desirable properties, or, in one embodiment, to remove any free formaldehyde from the treated fabric.

One serious problem associated with such treatment of textile fabric concerns the presence of free formaldehyde on the treated textile fabrics and finished garments, as well as either after such treatment or after storage of the treated fabrics or finished garments. The presence of free formaldehyde on the fabrics, or derived from the storage of the fabrics under humid conditions, arises from the employment of the N-methylol monomeric compounds used in the treating process. The presence of free formaldehyde is objectionable not only due to its odor and the retention of the odor, particularly in garment-handling and fabrication areas of the plant, and more particularly in air-conditioned plants, but also due to the possibility of allergenic and irritating reactions to those people in the chemical-treating area or those who handle or wear such garments containing such treated fabrics. The problems associated with free formaldehyde on treated textile fabrics are well known, and have been the object of considerable efforts to produce formaldehyde-free textile fabrics, or, at the very least, to produce textile fabrics having a reduced free formaldehyde thereon.

Historically, urea and other urea compounds, such as the cyclic ethylene and propylene urea, have been employed as scavengers for free formaldehyde in the textile-furnishing field, in order to reduce substantially the free formaldehyde, and, therefore, diminish the formaldehyde odor associated with the treated textile material (see, for example, U.S. Pat. No. 3,590,100, hereby incorporated by reference). However, the use of urea is not wholly satisfactory in that the textile retains undesirable odors, and, in addition, the use of excess urea tends to alter the buffered cure of the fabric and to alter the textile properties of the treated fabric, such as the hand properties. In addition, the free-formaldehyde content of the aminoplast used in the textile-treating bath has been reduced in a separate operation also by removal of the free formaldehyde by reaction with phthalimide to form an insoluble adduct with the free formaldehyde, which adduct may be separated from the aminoplast-treating solution before treatment of the fabric (see U.S. Pat. No. 3,723,058, hereby incorporated by reference).

Another technique provides for a process for scavenging free formaldehyde, wherein the cellulosic textile material, after having been impregnated with a solution of an aminoplast-forming substance and dried, is sprayed or padded with a solution of urea or another formaldehyde acceptor (see U.S. Pat. No. 3,957,431, hereby incorporated by reference). Urea is stated as the preferred compound suitable for use in the process, but other five-membered, carbonyl-containing, heterocyclic, nitrogen-containing ring compounds are also stated as being effective formaldehyde scavengers in the post-treatment of the treated textile fabric. Such cyclic compounds include the cyclic urea compounds, wherein the imide nitrogen reacts particularly rapidly with the free formaldehyde. In this process, the spraying or padding of the treated textile material with the formaldehyde-acceptor solution is carried out after drying, and in the post-cure process.

U.S. Pat. No. 3,749,751 discloses the use of an amide or pyrrolidone-type compound for reduction of formaldehyde in coating solutions containing methylated carbamates. U.S. Pat. No. 3,723,377 discloses the use of 4,5-dihydroxy-2-imidazolinone (DHEU) and its derivatives to reduce formaldehyde or aqueous mixtures containing carbamates for coating. U.S. Pat. No. 3,597,380 teaches the use of melamine with solutions of methylated carbamates having free formaldehyde to reduce the free-formaldehyde content.

The problems associated with formaldehyde in textile-finishing solutions employed in the recent past are set forth and are described in "Formaldehyde and Textile Finishing", Bille and Petersen, Melliand Textilberichte, February 1976 (hereby incorporated by reference).

Although past processes have been effective in some regard in reducing free formaldehyde, such processes have not proven wholly satisfactory. For example, the use of urea or ethylene urea is unsatisfactory, due to the requirement for a high concentration to effect substantial reductions and the associated changes occasioned by such high concentration, and the effect on light fasteners, when ethylene urea is employed. The requirement for special pretreatment for the separation of an insoluble adduct, as when phthalimides are employed, to scavenge formaldehyde is also undesirable. In addition, other processes require separate spraying and padding treatments and additional drying, which add to the cost and expense of such processes.

Therefore, there is a need for a process to provide for the reduction of free formaldehyde in cellulosic-containing articles, particularly treated textile fabrics, which process would provide for the reduction of formaldehyde to low, acceptable and tolerable limits by the use of only small quantities of materials in a simple process, such as low quantities of additive materials in the textile-treating bath, and the use of materials which avoid undesirable alterations in the article so treated.

SUMMARY OF THE INVENTION

My invention relates to a process for the reduction of free formaldehyde in or on cellulosic-type articles, particularly textile materials, to the compositions employed in such process, and to low formaldehyde articles so produced. In particular, my invention concerns a process for employing an additive formaldehyde scavenger in a methylol-containing textile-material-treating bath employed to treat a cellulosic-containing textile material, to the textile-treating bath containing the additive, and to the textile material so treated. More particularly, my discovery is directed to the employment of benzotriazole or pyrrole and similar compounds as an additive in an aqueous N-methylol-containing, textile-treating bath for cellulosic-containing fabrics, to the textile bath employed in the process, and to the textile material so treated.

I have discovered that certain nitrogen-containing, heterocyclic compounds, including fused aryl-ring heterocyclic compounds, are particularly suited for use in reducing free-formaldehyde cellulosic articles. My compounds are particularly effective as additives to textile-treating baths containing aminoplast-forming substances for the treatment of cellulosic textile fabrics. I have found that the fused, aryl-ring, nitrogen-containing, five-membered, saturated or unsaturated, heterocyclic ring compounds, and certain nonfused, unsaturated, heterocyclic ring compounds, are effective at low concentrations in reducing the amount of free formaldehyde on textile material to levels as low as 1,000 parts per million or lower.

The use of my compounds avoids many of the problems associated with prior-art compounds, and in particular often permits the employment of low concentrations of my scavenger compound in contrast to prior-art urea-derivative compounds. My scavenger compound avoids odor problems, change in hand properties, high concentrations and special equipment and additional processing steps required in the prior art. My free-formaldehyde scavenger compounds may be employed directly as additives in the N-methylol-containing, conventional, textile-treating bath in low concentrations, as low as 2%; for example, 1%, based on the weight of the bath, or lower; for example, 0.1% to 0.5% by weight, to provide for reduction in free formaldehyde to a level to 1,000 parts per million on the article, or lower; for example, 500 ppm. If desired, my compounds may be employed, alone or in combination with other compounds, in an after-wash-treating solution to provide for the reduction of free formaldehyde which might occur on the articles during storage or prior to use and fabrication. My scavenger compounds may be combined with and added to N-methylol textile-treating compositions prior to making up or adding such compositions to the treating bath. My scavenger compounds, when employed in such compositions, reduce the formaldehyde odor and eliminate the need to add the compound after the treating-bath makeup.

My compounds function as free-formaldehyde scavenger compounds, although the method and theory of operation are not understood fully. My compounds provide for the practical, simple and effective reduction of free formaldehyde by the employment of effective amounts of my additive scavenger compounds directly in the textile-treating bath and a textile after-wash, and avoid many problems associated with prior-art compounds and processes.

My invention relates to a process for treating a cellulosic article, particularly a cellulosic-textile article, to remove or reduce free formaldehyde, which process comprises contacting the article containing the free formaldehyde with a liquid containing my scavenger compound. The free-formaldehyde scavenger compounds useful in my invention comprise those NH-group-containing heterocyclic compounds containing unsaturation, the NH group directly bonded to a carbon or nitrogen atom which is part of an ethylenically unsaturated bond, and include five- or six-membered saturated or unsaturated heterocyclic rings fused to an aryl group, such as a substituted or unsubstituted phenyl group, with the NH group bonded to a carbon of the aryl ring, or an unsaturated, particularly a conjugated, ethylenically unsaturated, heterocyclic-dicyclic, compound. The scavenger compounds are characterized by the unsaturated group —NH—X=X—, particularly in the nonfused heterocyclic or in the fused phenyl heterocyclic compounds where X is a carbon atom bonded to hydrogen or to an alkyl radical; for example, $C_1$–$C_4$ alkyl radical, or X is a nitrogen atom or X may be the same or different. The remaining part of the ring comprises carbon atoms bonded to hydrogen or alkyl radicals.

Where the scavenger is a nonfused heterocyclic compound, the preferred structure has a conjugated diene-type unsaturation, such as with a conjugated ring structure, with the NH group having an apex position between two ethylenically unsaturated atoms of carbon-to-carbon, carbon-to-nitrogen or nitrogen-to-nitrogen. Such nonfused heterocyclic compounds are represented by imidazole, indole, 1,2,4-triazole and pyrrole which possesses a degree of aromaticity due to the conjugated unsaturation in the ring structure.

Where the scavenger compound is a fused heterocyclic ring compound, the fused ring is preferably a benzyl or phenyl ring or a substituted ring, such as substituted by one, two, three or four alkyl radicals; for example a $C_1$–$C_4$ alkyl radicals like methyl, or other substituents or combinations thereof.

The heterocyclic ring portion of the scavenger compound may be unsaturated or saturated; that is, have the group —NH—X=X— (supra), or be saturated where the group is represented by —NH—X—X— where the nitrogen atom will be bonded to a hydrogen, and the carbon atom to two hydrogens or two alkyl radicals, or to a hydrogen and an alkyl radical. In its simple and preferred form, X would represent carbon atoms, each with two bonded hydrogen atoms. The fusion of the saturated NH heterocyclic ring with the phenyl ring also provides the —NH—X=X— group, except as part of the ring fused to the phenyl group, so that both X groups are carbon atoms of the phenyl ring. A representative compound would be indoline.

Where the fused heterocyclic ring compound contains an unsaturated heterocyclic ring, the ring will have the group —NH—X=X— (supra). Representative compounds would include: 5-methylbenzimidazole; benzimidazole; 2-methylbenzimidazole; benzotriazole; and indole.

My scavenger compounds may be represented as follows:

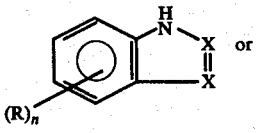

or (I)

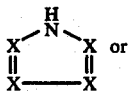

or (II)

-continued

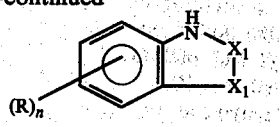

(III)

wherein: R is a substituent radical, preferably an alkyl radical, such as a methyl radical; $n$ is a whole number integer of 0, 1, 2, 3 or 4; X is a carbon atom bonded to a hydrogen or to an alkyl radical; or X is a nitrogen atom, and X may be the same or a different atom; and $X_1$ is a nitrogen atom bonded to a hydrogen atom, or is a carbon atom bonded to two hydrogen or two alkyl radicals, or to one hydrogen and one alkyl radical.

The preferred compound includes:

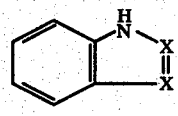

(IV)

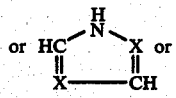

(V)

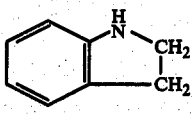

(VI)

Representative group in each respective compound:

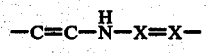

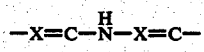

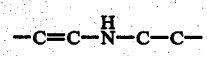

For the purposes of my invention, my scavenger compounds, including the fused ring-saturated, heterocyclic ring compounds, shall be deemed to be included in the group —NH—X=X— (also —X=X—NH—) as defined.

Typical formaldehyde scavenger compounds useful in the process of my invention include, but are not limited to: benzimidazole; 5-methylbenzimidazole; 2-methylbenzimidazole; indole; pyrrole; 1,2,4-triazole; indoline; benzotriazole and the like, with benzotriazole and pyrrole being the preferred compounds as additives to an N-methylol, aqueous textile-treating bath.

My scavenger compounds may be added in an effective amount as additives to aqueous textile-treating baths containing aminoplast substances, such as those cellulosic-reactive compounds used to provide a permanent-press finish to textile fabrics, and in particular the glyoxal-base, cross-linking, N-methylol compounds employed in textile baths. My scavenger compounds may be used in either post-cure or precure processes to reduce free formaldehyde. My scavenger compounds may also be employed in other treating liquids; for example, in after-wash liquids, in the N-methylol compound itself, or other compositions, wherein it is desired to reduce free formaldehyde. The concentration of my scavenger compound in such liquids may vary, depending on the results desired and other factors. However, when employed in textile-treating baths, an effective amount of my compound would be represented by an amount sufficient to reduce the free formaldehyde on the textile material to 1,000 parts per million, although in particular to less than 500 parts per million; for example, 300 ppm. When employed in textile-treating baths on the weight of the bath, my scavenger compound is often employed in an amount of less than about 1%, and, with the preferred compound, ranges from about 0.1% to about 0.8% by weight of bath. My scavenger compounds may be added directly and dissolved in the textile-treating bath, or be employed or added in emulsion form with an effective surface-active agent, such as a nonionic, cationic or anionic agent surfactant, which are not affected by the components or the degree of acidity or basicity of the textile-treating bath. My scavengers may also be used with solvents and other materials to promote solution of the compounds, such as alcohols and glycols.

The textile-treating bath used to impregnate cellulosic articles, such as textile fabrics, is an aqueous bath containing suitable aminoplast-forming substances, particularly the methylol compounds and alkoxymethyl compounds of acyclic or cyclic ureas, and particularly, but not limited to, glyoxal-based, cross-linkable urea compounds in an amount usually from 5% to 25% by weight of the bath. Such textile baths also contain a catalyst to effect the desired reaction on the application of heat, such catalyst being present in an amount from about 1.0% to 30% by weight of the aminoplast, and include acidic salts or salts which form acidic compounds which include, but are not limited to, such salts as in magnesium chloride, zinc salts, such as zinc nitrate, zinc chloride and the like, as well as amine salts which form acids on heating. The textile-treating bath in addition may contain other conventional agents and additives and combinations thereof, such as surfactants, flame-retardant agents, water and oil repellants, antistatic agents, softeners, and other resins, resin finishes, dyes, pigments, binders, buffers, wetting agents. Typical textile-treating baths and their compositions are set forth in U.S. Pat. No. 3,957,431, supra.

In my process, after the preparation of the textile-finishing bath, my scavenger compound is added to the bath in an effective amount to reduce the free formaldehyde. The textile fabric is impregnated employing the textile-bath liquid, such as by a padding technique, such as that of about room temperature. Excess textile-bath material is removed from the fabric where desired, and the fabric is then predried to approximately 20% to 50% moisture content, and, thereafter, is dried at temperatures optionally, for example, of 200° F. to as high as 400° F. If desired, some curing or all curing can be completed during this drying operation. However, and typically, after drying, the treated textile material is cured, either before fabrication or after fabrication, into the desired garment or finished article by heating to a high temperature to effect cross-linking and condensation; for example, at temperatures of 300° F. to 400° F. at times ranging from 30 seconds to 15 minutes, with the time and temperature depending upon the formulation, fabric weight, processing conditions and other factors.

Optionally, the textile fabric, after drying and before curing or after curing and storage and before finishing, may be after-washed. In such cases, an aqueous after-wash containing softening agents and surface-active or wetting agents, and optionally soda ash, fillers, optical brighteners, fabric softeners, stabilizers, bactericides and the like, may be employed to wash the treated textile fabric, and, thereafter, the fabric may be dried and followed by shrinking or other treatment if desired. Where free formaldehyde is on the fabric after curing, the free formaldehyde may be reduced by including in the after-wash or in other treatments, such as spraying, an effective amount of my scavenger compound; for example, directly into the after-wash liquid, and in the shrinking treatment where spraying is used.

My scavenger compounds may be used in a process wherein the textile material comprises cellulosic material, such as cotton, rayon and the like, alone or with blends, such as polyesters, nylon or the like, and may be used for finishing textiles; for example, woven or non-woven and knitted fabrics which contain cellulosic materials.

My invention will be described for the purposes of illustration only in connection with the reduction of free formaldehyde on a particular textile-treating material. However, as will be recognized by those persons skilled in the art, it is within the scope of my invention that various changes and modifications may be made in the process, without departing from the spirit and scope of my invention.

DESCRIPTION OF THE PREFERRED EMBODIMENTS

A cellulosic-type textile fabric was immersed into an aminoplast-forming substance, aqueous, textile-treating bath containing various free-formaldehyde scavenger compounds of my invention. The treated material was then dried, and, thereafter, cured, and the amount of free formaldehyde on such treated textile fabrics was then determined in accordance with the standard AATCC test method No. 112-1975. The test fabric employed as a 100% standard test cotton fabric which was immersed into a standard N-methylol, monomeric compound, aqueous, textile-treating bath, which textile-treating bath comprised an aqueous formulation containing:

(1) Permafresh* LF-2 — a low-formaldehyde, glyoxal-based, cross-linkable reactant used to provide a permanent-press finish to textile fabrics, which comprises a dimethylol glyoxal mono-urein compound— OWB** 25%.

(2) An acid catalyst zinc nitrate — OWB 5%.

(3) A wetting agent, a nonionic alkylphenoxypolyethoxy ethylene compound — OWB 0.1%.

(4) A free-formaldehyde scavenger compound as shown in Table I.

**OWB represents the weight percentage based on the weight of bath.
*Permafresh is a registered trademark of Sun Chemical Corporation.

The cotton test fabric was immersed in the bath and had a wet pickup of the bath of approximately 65% to 75%. The test fabric was then air-dried, and, thereafter, cured on a pin frame in a forced hot-air draft oven for 1 to 6 minutes at a temperature of approximately 320° F. to 330° F. The fabric so dried and cured was then tested for free formaldehyde in accordance with the standard AATCC test method.

The test results shown with various free-formaldehyde scavenging compounds of my invention are set forth in Table I.

TABLE I

| Additive | Formula | % Concentration OWB | ppm formaldehyde |
|---|---|---|---|
| 1. 5-methylbenzimidazole | 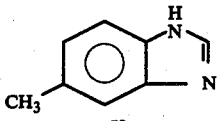 | 0.64 | 800 |
| 2. benzimidazole | 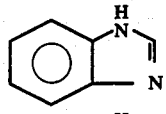 | 0.32<br>0.64<br>1.20 | 475<br>625<br>1100 |
| 3. 2-methylbenzimidazole | 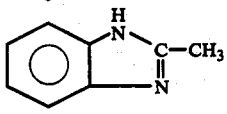 | 0.64 | 875 |
| 4. imidazole | 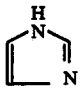 | 0.64 | 1200 |
| 5. benzotriazole | 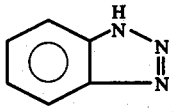 | 0.16<br>0.32<br>0.64<br>0.80<br>1.00<br>1.20 | 850<br>650<br>350<br>400<br>600<br>1800 |
| 6. indole | 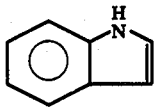 | 0.32<br>0.64 | 400<br>(precipitate pink color on fabric) |
| 7. 1,2,4-triazole | 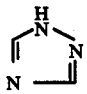 | 0.32<br>0.64<br>1.20 | 375<br>425<br>500 |
| 8. pyrrole | 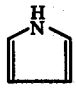 | 0.32<br>0.64<br>1.20 | 475<br>450<br>375<br>(pink color on fabric) |

TABLE I-continued

| Additive | Formula | % Concentration OWB | ppm formaldehyde |
|---|---|---|---|
| 9. indioline | 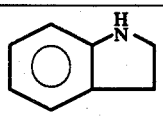 | 0.32<br>0.64<br>1.20 | 400<br>375<br>150<br>(bright yellow on fabric) |

The test results shown in particular in Table I illustrate the effectiveness of adding my free-formaldehyde scavenging compounds to the N-methylol textile-treating bath. The employment of amounts higher than about 1% of the benzotriazole is undesirable, since the amount of free formaldehyde tends to increase, which is probably associated with solubility problems of the free-scavenger additive in the textile-treating bath. Although a number of compounds produced a coloration on the treated textile fabric, such compounds are useful where color is of less importance, such as in particle-board manufacture, or where the color may be masked by the use of dyes or where the textile fabric is to be treated substantially and dyed, or the fabric is not seen in use.

My formaldehyde scavenger compounds and the process for which they are used have been described in particular in connection with the treatment of cellulosic-type textile fabrics. However, it is recognized and is within the spirit and scope of my invention that my free-formaldehyde scavenger compounds may be employed in the contacting and treating of other articles containing free formaldehyde, and in particular cellulosic articles containing free formaldehyde, such as those articles treated with aminoplast-forming substances, such as urea-formaldehyde resins. In particular, my compounds and process may be employed in the cross-linkable resin formulation used in preparing particle boards, either as an additive to the resin-treating composition prior to the formation of the particle board, or after formation and curing of the resin after treatment of the particle board in order to remove or reduce free formaldehyde on the particle-board product. My scavenger compounds are also usefully employed where methylol resins are used in treating paper and paper products, such as to improve the wet strength of the paper.

What I claim is:

1. A process of reducing free formaldehyde to less than about 1000 ppm formaldehyde on cellulosic-containing methylol-treated material, which process comprises contacting the material, containing the formaldehyde, with an aqueous solution having an effective amount of less than about 2 percent by weight of a free-formaldehyde scavenger compound which comprises a heterocyclic ring compound free of a carbonyl group, and containing an NH group, with the ring made up of nitrogen or carbon atoms, the ring being unsaturated or, when fused to a phenyl group, being unsaturated or saturated, and the NH group bonded to a carbon or a nitrogen atom, which atom is directly bonded by a double bond to another carbon or nitrogen atom.

2. The process of claim 1 wherein the cellulosic-containing material is a cellulosic-containing textile fabric.

3. The process of claim 2 wherein the contacting includes the step of adding the scavenger compound to an N-methylol-containing textile-material-treating bath, which bath is used to contact the methylol-treated material.

4. The process of claim 1 wherein the heterocyclic compound contains a five-membered heterocyclic ring with the group —NH—X=X—, wherein X is a nitrogen atom or X is a carbon atom bonded to a hydrogen atom or to an alkyl radical.

5. The process of claim 4 wherein the heterocyclic ring compound comprises a heterocyclic ring fused to a phenyl group.

6. The process of claim 1 wherein the heterocyclic compound comprises a five-membered saturated ring, with the NH bonded to the carbon atom of a fused phenyl ring.

7. The process of claim 3 wherein the heterocyclic compound is added in an amount of less than about 1% by weight on the weight of the textile-treating bath.

8. The process of claim 1 wherein the heteocyclic compound is selected from the group consisting of 5-methylbenzimidazole, benzimidazole, 2-methylbenzimidazole, imidazole, benzotriazole, indole, triazole, pyrrole, indoline and combinations thereof.

9. The process of claim 1 wherein the cellulosic-containing material comprises a particle board or paper.

10. The process of claim 2 which comprises contacting the textile fabric, after curing of the N-methylol, with an aqueous solution containing the heterocyclic scavenger compound.

11. The process of claim 2 wherein the material is contacted by padding the material with an aqueous textile-treating liquid containing a monomeric or polymeric N-methylol compound, an acid catalyst to effect cure of the methylol compound and an effective amount of the heterocyclic scavenger compound.

12. The process of claim 1 wherein the cellulosic-treated material comprises a textile fabric which includes cotton, and rayon and blends thereof, and wherein the effective amount of the heterocyclic scavenger compound reduces the amount of free formaldehyde to less than 500 ppm.

13. The process of claim 2 which includes the step of adding the scavenger compound to an N-methylol monomeric-polymeric composition prior to contacting the textile fabric in a textile-treating bath prepared with such composition.

14. A process of reducing free formaldehyde on a cellulosic-containing textile fabric material, which process comprises contacting the textile fabric in an aqueous textile-treating bath to impregnate the textile fabric, which bath comprises an N-methylol cross-linkable compound, a catalyst to effect the curing of the methylol compound, and an effective amount of a heterocyclic compound as a free-formaldehyde scavenger in the textile-treating bath, the compound selected from the group consisting of 5-methylbenzimidazole, benzimidazole, 2-methylbenzimidazole, imidazole, benzotriazole, indole, triazole, pyrrole, indoline and combinations thereof, the scavenger compound being present in an effective amount sufficient to reduce the amount of free formaldehyde on the treated impregnated fabric to less than about 1000 ppm of free formaldehyde.

15. A process for reducing the free-formaldehyde content of a methylolated treating solution to less than about 1000 ppm of free formaldehyde adapted for use in the solution treating cellulosic-containing materials, which method comprises: contacting the free formaldehyde, in an aqueous solution of a monomeric N-methylol compound, with a formaldehyde scavenger compound which comprises a heterocyclic ring compound free of a carbonyl group, and containing an NH group, with the ring made up of nitrogen or carbon atoms, the ring being unsaturated or, when fused to a phenyl group, being unsaturated or saturated, and the NH group bonded to a carbon or a nitrogen atom, which atom is directly bonded by a double bond to another carbon or nitrogen atom the scavenger compound present in an amount of less than about 2 percent by weight of the solution.

16. The process of claim 15 wherein the methylolated solution comprises a low-formaldehyde, glyoxal-based, cross-linkable compound, a catalyst to effect curing of the cross-linkable compound, and a scavenger compound selected from the group consisting of 5-methylbenzimidazole, benzimidazole, 2-methylbenzimidazole, imidazole, benzotriazole, indole, triazole, pyrrole, indoline and combinations thereof.

17. A textile-treating-bath composition adapted for use in the treatment of a textile fabric, which bath composition comprises an aqueous solution of an N-methylol cross-linkable compound, a catalyst in an amount to effect curing of the methylol compound on heating, and an effective amount of a free-formaldehyde scavenger compound, which compound comprises a heterocyclic ring compound free of a carbonyl group, and containing an NH group, with the ring made up of nitrogen or carbon atoms, the ring being unsaturated or, when fused to a phenyl group, being unsaturated or saturated, and the NH group bonded to a carbon or a nitrogen atom, which atom is directly bonded by a double bond to another carbon or nitrogen atom the scavenger compound present in an amount of less than about 2% by weight of the solution.

18. The process of claim 1 wherein the scavenger compound is represented by the formula:

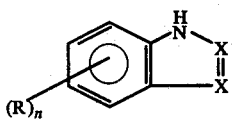

wherein R is a $C_1$–$C_4$ alkyl radical; $n$ is an integer of 0, 1, 2, 3 or 4; X is a carbon atom bonded to a hydrogen or to an alkyl radical or X is a nitrogen atom.

19. The bath composition of claim 17 wherein the scavenger compound is selected from the group consisting of 5-methylbenzimidazole, benzimidazole, 2-methylbenzimidazole, imidazole, benzotriazole, indole, triazole, pyrrole, indoline and combinations thereof.

20. The process of claim 3 wherein the heterocyclic compound is added to in an amount of from about 0.1% to about 0.8% by weight of the textile-material-treating bath.

21. The process of claim 3 wherein the N-methylol-containing textile-material-treating bath comprises a solution which contains dimethylol glyoxal mono-urein as the N-methylol compound.

22. The bath composition of claim 17 wherein the N-methylol cross-linkable compound of the textile-treating-bath composition comprises a glyoxal-based cross-linkable urea compound.

23. The bath composition of claim 22 wherein the glyoxal based cross-linkable urea compound comprises dimethylol glyoxal mono-urein.

24. The bath composition of claim 17 wherein the scavenger compound is present in an amount of less than about 1% on the weight of the bath.

25. The bath composition of claim 17 wherein the scavenger compound is selected from the group consisting of:

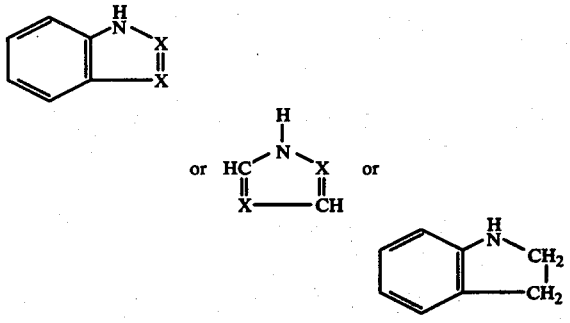

wherein X is a nitrogen atom or a carbon atom bonded to hydrogen or to an alkyl radical.

26. The bath composition of claim 17 wherein the scavenger compound is benzotriazole in an amount of from about 0.1% to about 0.8% on the weight of the bath.

27. A textile-treating bath composition adapted for use in the treatment of a textile fabric which bath composition comprises an aqueous solution of from about 5% to 25% by weight of a dimethylol glyoxal monourein compound from about 1% to 30% by weight of a catalyst to effect curing of the mono urein compound on heating, and less than about 1.0% by weight of benzotriazole as a free formaldehyde scavenger compound.

* * * * *